US009534512B2

(12) United States Patent
McConville et al.

(10) Patent No.: US 9,534,512 B2
(45) **Date of Patent: *Jan. 3, 2017**

(54) ACTUATOR FOR LOBE SWITCHING CAMSHAFT SYSTEM

(71) Applicant: Ford Global Technologies, LLC, Dearborn, MI (US)

(72) Inventors: Gregory Patrick McConville, Ann Arbor, MI (US); Kim Hwe Ku, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 127 days.

This patent is subject to a terminal disclaimer.

(21) Appl. No.: 14/459,112

(22) Filed: Aug. 13, 2014

(65) Prior Publication Data

US 2014/0366836 A1 Dec. 18, 2014

Related U.S. Application Data

(63) Continuation of application No. 13/734,768, filed on Jan. 4, 2013, now Pat. No. 8,813,699.

(51) Int. Cl.

| | |
|---|---|
| ***F01L 1/34*** | (2006.01) |
| ***F01L 1/22*** | (2006.01) |
| ***F01L 13/00*** | (2006.01) |

(52) U.S. Cl.

CPC ..... *F01L 1/22* (2013.01); *F01L 13/0036* (2013.01); *F01L 2013/0052* (2013.01); *F01L 2820/031* (2013.01)

(58) Field of Classification Search

CPC .. F01L 1/22; F01L 13/0036; F01L 2013/0052; F01L 2820/031

USPC ..... 123/90.16, 90.18, 90.17

See application file for complete search history.

(56) References Cited

U.S. PATENT DOCUMENTS

| | | | | |
|---|---|---|---|---|
| 6,966,291 | B1 | 11/2005 | Fischer et al. | |
| 7,125,058 | B2 | 10/2006 | Hawthorne | |
| 7,404,383 | B2 | 7/2008 | Elendt | |
| 7,946,263 | B2 * | 5/2011 | O'Neill | F01L 1/143 123/295 |
| 8,161,930 | B2 | 4/2012 | Elendt et al. | |
| 8,813,699 | B2 * | 8/2014 | McConville | F01L 1/22 123/90.16 |
| 2011/0240892 | A1 | 10/2011 | Nendel | |

* cited by examiner

*Primary Examiner* — Ching Chang

(74) *Attorney, Agent, or Firm* — Julia Voutyras; Alleman Hall McCoy Russell & Tuttle LLP

(57) ABSTRACT

Systems and methods for actuating lobe switching in a camshaft system in an engine are disclosed. In one example approach, a method comprises deploying a first pin into a groove of a camshaft outer sleeve while a second pin remains in place due to an absence of a groove in which to deploy, and maintaining the second pin in place with a ball locking mechanism even after the second pin is exposed to a vacated groove in the camshaft outer sleeve.

15 Claims, 7 Drawing Sheets

ACTUATOR FOR LOBE SWITCHING CAMSHAFT SYSTEM

CROSS REFERENCE TO RELATED APPLICATIONS

The present application is a continuation of U.S. patent application Ser. No. 13/734,768, "ACTUATOR FOR LOBE SWITCHING CAMSHAFT SYSTEM," filed on Jan. 4, 2013, the entire contents of which are hereby incorporated by reference for all purposes.

BACKGROUND AND SUMMARY

Engines may use cam switching systems to adjust valve lift of gas exchange valves in the cylinders. For example, cam lobes coupled to an engine cam shaft may have different lift profiles, such as full lift, partial lift, or zero lift. For example, such engines may incorporate cam profile switching (CPS) to enable high or low lift valve train modes which correspond to increased fuel efficiency during high and low engine speeds, respectively. As another example, e.g., by switching to a zero lift profile, engine cylinders may be deactivated during operation modes with decreased engine output in order to increase fuel efficiency.

As described for example in U.S. Pat. No. 7,404,383, an engine may include a camshaft with multiple outer sleeves containing lobes splined to a central cam. By engaging a pin into a grooved hub in each sleeve, the axial position of the sleeve can be repositioned so that a different cam lobe engages a roller finger follower (RFF) of a valve.

Various actuator and groove configurations are known for these types of valve switching mechanisms. In one approach for a two step system, a two-pin actuator may interface with a Y-groove to allow shifting of the sleeve in either direction depending on its starting point. One type of actuator may allow both pins to deploy when energized unless the pin is physically blocked because no groove is under it. After a pin has sufficiently extended, the actuator can be de-energized, and the pin will remain extended until the groove depth is reduced, pushing it back to the home position, where it remains until the actuator is again energized.

The inventors herein have recognized that, in approaches which activate both pins, a timing window may exist where the actuator can be energized until the intended pin deploys in its groove, then the actuator must be de-energized before the other pin falls into the unintended groove which it passes over as the sleeve moves. If the actuator is not de-energized in time, the second pin could fall in the groove causing a mechanical interference. This mechanical interference would likely result in substantial damage to the system. Previous solutions using the Y-mechanism for a two-step shifting sleeve camshaft have used actuators with individual control of the pins. However, having individual control of the pins typically requires two coils per actuator as well as twice as many control signals from the engine control module, thus increasing costs associated with such systems.

In one example approach, in order to address these issues, a method for a multiple-lift profile cam lobe switching mechanism actuator in an engine comprises deploying a first pin into a groove of a camshaft outer sleeve while a second pin remains in place due to an absence of a groove in which to deploy, and maintaining the second pin in place with a ball locking mechanism even after the second pin is exposed to a vacated groove in the camshaft outer sleeve.

In this way, a second pin may be prevented from deploying after the first (intended) pin has deployed by using a mechanical locking mechanism within the actuator, so that the second pin does not fall into the unintended groove which it passes over as the sleeve moves. Further, in such an approach, only a single coil may be used to actuate both pins, leading to potential reduction in costs associated with additional actuators and control mechanisms.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
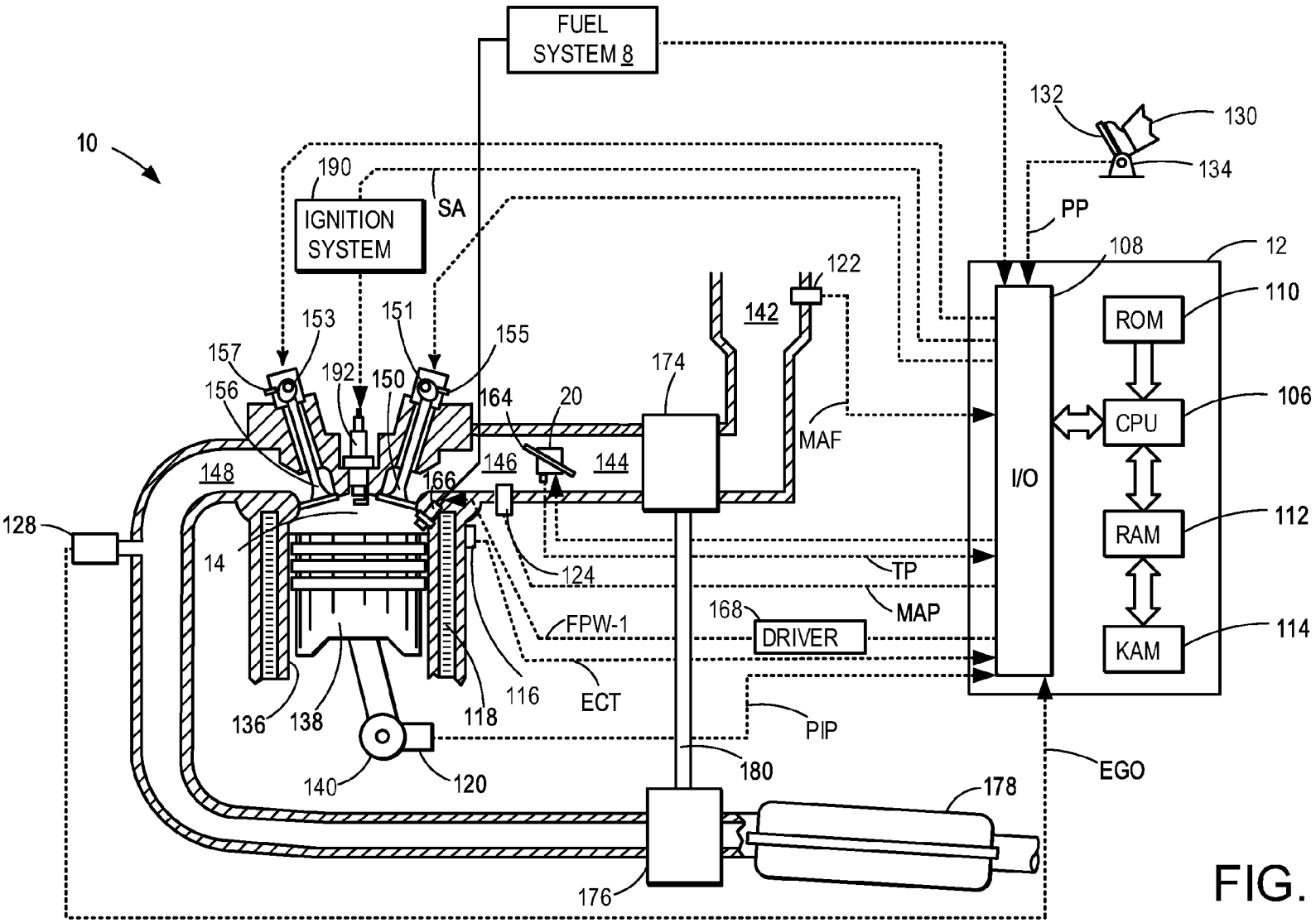
FIG. 1 shows a schematic diagram of one cylinder of an example engine system.
Figure 2:
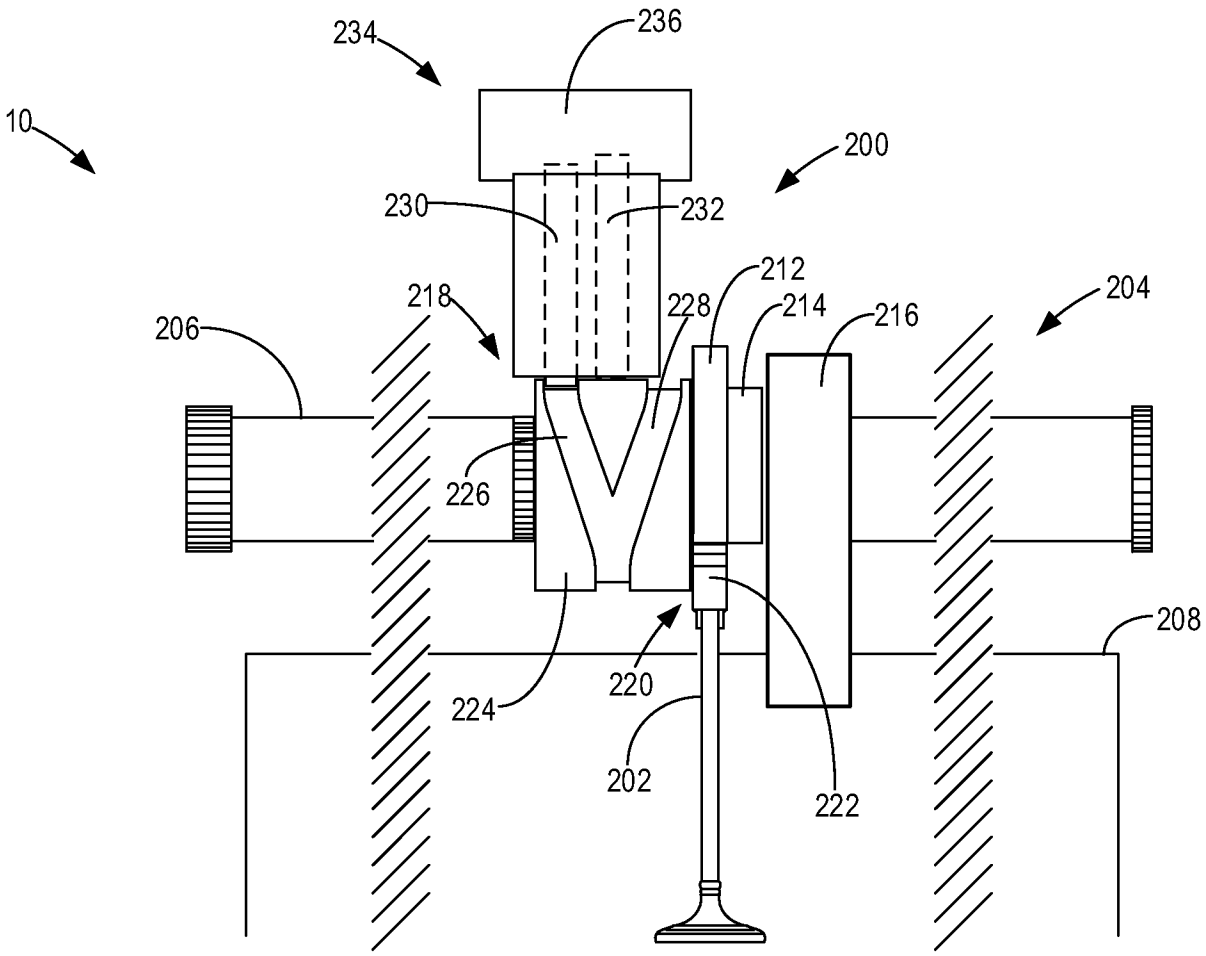
FIG. 2 shows an example cam lobe switching system in accordance with the disclosure.

The following description relates to systems and methods for a cam switching system in an engine used to adjust valve lift of gas exchange valves in cylinders of the engine, such as the engine shown in FIG. 1. As shown in FIG. 2, an engine may include a camshaft with multiple outer sleeves containing lobes splined to a central camshaft. By engaging a pin into a grooved hub in each sleeve, the axial position of the sleeve can be repositioned so that a different cam lobe engages a follower of a valve, e.g., a roller finger follower (RFF), a slider finger follower, or a shaft-mounted follower. As shown in FIGS. 3-6 and described in the method of FIG. 7, a cam lobe switching actuator may include a ball locking mechanism so that a first pin may be deployed into a groove of a camshaft outer sleeve while a second pin remains in place due to an absence of a groove in which to deploy. After the first pin is deployed in the groove, the second pin may be held in a home position with the ball locking mechanism even after the second pin is exposed to a vacated groove in the camshaft outer sleeve. In some examples, the second pin may move slightly before being prevented from further movement by the ball locking mechanism. The control groove surface can be designed to accommodate this small movement by including a ramp feature on the edge of the groove where the pin would otherwise interfere.

Turning now to the figures, FIG. 1 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 1, or alternatively may be provided upstream of compressor 174.

Exhaust passage 148 may receive exhaust gases from other cylinders of engine 10 in addition to cylinder 14. Exhaust gas sensor 128 is shown coupled to exhaust passage 148 upstream of emission control device 178 although in some embodiments, exhaust gas sensor 128 may be positioned downstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be measured by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system. An example cam actuation system is described in more detail below with regard to FIG. 2.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for delivering fuel. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12.

It will be appreciated that, in an alternate embodiment, injector 166 may be a port injector providing fuel into the intake port upstream of cylinder 14. Further, while the example embodiment shows fuel injected to the cylinder via a single injector, the engine may alternatively be operated by injecting fuel via multiple injectors, such as one direct injector and one port injector. In such a configuration, the controller may vary a relative amount of injection from each injector.

Fuel may be delivered by the injector to the cylinder during a single cycle of the cylinder. Further, the distribution and/or relative amount of fuel or knock control fluid delivered from the injector may vary with operating conditions, such as air charge temperature, as described herein below. Furthermore, for a single combustion event, multiple injections of the delivered fuel may be performed per cycle. The multiple injections may be performed during the compression stroke, intake stroke, or any appropriate combination thereof. It should be understood that the head packaging configurations and methods described herein may be used in engines with any suitable fuel delivery mechanisms or systems, e.g., in carbureted engines or other engines with other fuel delivery systems.

As described above, FIG. 1 shows only one cylinder of a multi-cylinder engine. As such each cylinder may similarly include its own set of intake/exhaust valves, fuel injector(s), spark plug, etc.

FIG. 2 shows an example cam lobe switching system 200 in an engine 10 configured to adjust a lift of a gas exchange valve 202 in response to engine operating conditions. Engine 10 includes a valve train 204 including a cam shaft 206 positioned above a cylinder head 208 of an engine bank 210. Valve 202 may be an intake valve or an exhaust valve, configured to open and close an intake port or exhaust port in a cylinder, such as cylinder 14 shown in FIG. 1. For example, valve 202 may be actuatable between an open position allowing gas exchange into or out of a cylinder and a closed position substantially blocking gas exchange into or out of the cylinder. It should be understood that though only one valve is shown in FIG. 2, engine 10 may include any number of cylinder valves. For example, engine 10 may include any number of cylinders with associated valves and a variety of different cylinder and valve configurations may be used, e.g., V-6, I-4, I-6, V-12, opposed 4, and other engine types.

One or more cam towers or cam shaft mounting regions may be coupled to cylinder head 208 to support cam shaft 206. For example, cam tower 216 is shown coupled to cylinder head 208 adjacent to valve 202. Though FIG. 2 shows a cam tower coupled to the cylinder head, in other examples, the cam towers may be coupled to other components of an engine, e.g., to a camshaft carrier or the cam cover. The cam towers may support overhead camshafts and may separate the lift mechanisms positioned on the camshafts above each cylinder.

Valve 202 may operate in a plurality of lift modes, e.g., a high valve lift, low or partial valve lift, and zero valve lift. For example, as described in more detail below, by adjusting cylinder cam mechanisms, the valves on one or more cylinders, e.g., valve 202, may be operated in different lift modes based on engine operating conditions.

Camshaft 206, which may be an intake camshaft or an exhaust camshaft, may include a plurality of cams configured to control the opening and closing of the intake valves. For example, FIG. 2 shows a first cam lobe 212 and a second cam lobe 214 positioned above valve 202. The cams lobes may have different shapes and sizes to form lift profiles used to adjust an amount and timing of a lifting of valve 202 while the cam shaft rotates. For example, cam 212 may be a full lift cam lobe and cam 214 may be a partial lift or low lift cam lobe. Though, FIG. 2 shows two lift profiles associated with first cam 212 and second cam 214, it should be understood that any number of lift profile cams may be present, e.g., three different cam lobes. For example, camshaft 206 may additionally include a zero lift cam used to deactivate valve 202 during certain engine operating conditions.

Valve 202 includes a mechanism 218 coupled to the camshaft above the valve for adjusting an amount of valve lift for that valve and/or for deactivating that valve by changing a location of cam lobes along the camshaft relative to valve 202. For example, the cam lobes 212 and 214 may be slideably attached to the cam shaft so that they can slide along the camshaft on a per-cylinder basis. For example, a plurality of cam lobes, e.g., cam lobes 212 and 214, positioned above each cylinder valve, e.g., valve 202, may be slid across the camshaft to change a lobe profile coupled to the valve follower, e.g., follower 220 coupled to valve 202, to change the valve opening and closing durations and lift amounts. The valve cam follower 220 may include a roller finger follower (RFF) 222 which engages with a cam lobe positioned above valve 202. For example, in FIG. 2, roller 222 is shown engaging with full lift cam lobe 212.

Additional follower elements not shown in FIG. 2 may further include push rods, rocker arms, tappets, etc. Such devices and features may control actuation of the intake valves and the exhaust valves by converting rotational motion of the cams into translational motion of the valves. In other examples, the valves can be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired. Further, in some examples, cylinders may each have only one exhaust valve and/or intake valve, or more than one intake and/or exhaust valves. In still other examples, exhaust valves and intake valves may be actuated by a common camshaft. However, in an alternate embodiment, at least one of the intake valves and/or exhaust valves may be actuated by its own independent camshaft or other device.

An outer sleeve 224 may be coupled to the cam lobes 212 and 214 splined to camshaft 206. The camshaft may be coupled with a cam phaser which is used to vary the valve timing. By engaging a pin, e.g., one of the pins 230 or 232, into a grooved hub in the outer sleeve, the axial position of the sleeve can be repositioned to that a different cam lobe engages the cam follower coupled to valve 202 in order to change the lift of the valve. For example, sleeve 224 may include one or more displacing grooves, e.g., grooves 226 and 228, which extend around an outer circumference of the sleeve. The displacing grooves may have a helical configuration around the outer sleeve and, in some examples, may form a Y-shaped or V-shaped groove in the outer sleeve, where the Y-shaped or V-shaped groove is configured to engage two different actuator pins, e.g., first pin 230 and second pin 232, at different times in order to move the outer sleeve to change a lift profile for valve 202. Further, a depth of each groove in sleeve 224 may decrease along a length of the groove so that after a pin is deployed into the groove from a home position, the pin is returned to the home position by the decreasing depth of the groove as the sleeve and camshaft rotate.

For example, as shown in FIG. 2, when first pin 230 is deployed into groove 226, outer sleeve 224 will shift in a direction away from cam tower 216 while cam shaft 206 rotates thus positioning cam lobe 214 above valve 202 and changing the lift profile. In order to switch back to cam lobe 212, second pin 232 may be deployed into groove 228 which will shift outer sleeve 224 toward cam tower 216 to position cam lobe 212 above valve 202. In some examples, multiple outer sleeves containing lobes may be splined to camshaft 206. For example, outer sleeves may be coupled to cam lobes above every valve in engine 10 or a select number of lobes above the valves.

Actuator pins 230 and 232 are included in a cam lobe switching actuator 234 which is configured to adjust the positions of the pins in order to switch cam lobes positioned above a valve. Cam lobe switching actuator 234 includes an activating mechanism 236, which may be hydraulically powered, or electrically actuated, or combinations thereof. Activating mechanism 236 is configured to change positions of the pins in order to change lift profiles of a valve. For example, activating mechanism 236 may be a coil coupled to both pins 230 and 232 so that when the coil is energized, e.g., via a current supplied thereto from the control system, a force is applied to both pins to deploy both pins toward the sleeve. Example cam lobe switching actuators are described in more detail below with regard to FIGS. 3-5.

As remarked above, in approaches which activate both pins at the same time, e.g., by using a single coil actuator coupled to both pins, a timing window may exist where the actuator can be energized until the intended pin deploys in its groove, then the actuator must be de-energized before the other pin falls into the unintended groove which it passes over as the sleeve moves. If the actuator is not de-energized in time, the second pin could fall in the groove causing a mechanical interference. Further, having individual control of the pins typically requires two coils per actuator as well as twice as many control signals from the engine control module, thus increasing costs associated with such systems. Thus, as shown in FIGS. 3-6, a cam lobe switching actuator 234 may include a ball locking mechanism 336 positioned between pins 230 and 232 in a body 314 of the actuator. As described in more detail below, the ball locking mechanism 336 may prevent one pin from deploying after the other (intended) pin has deployed.

Figure 3:
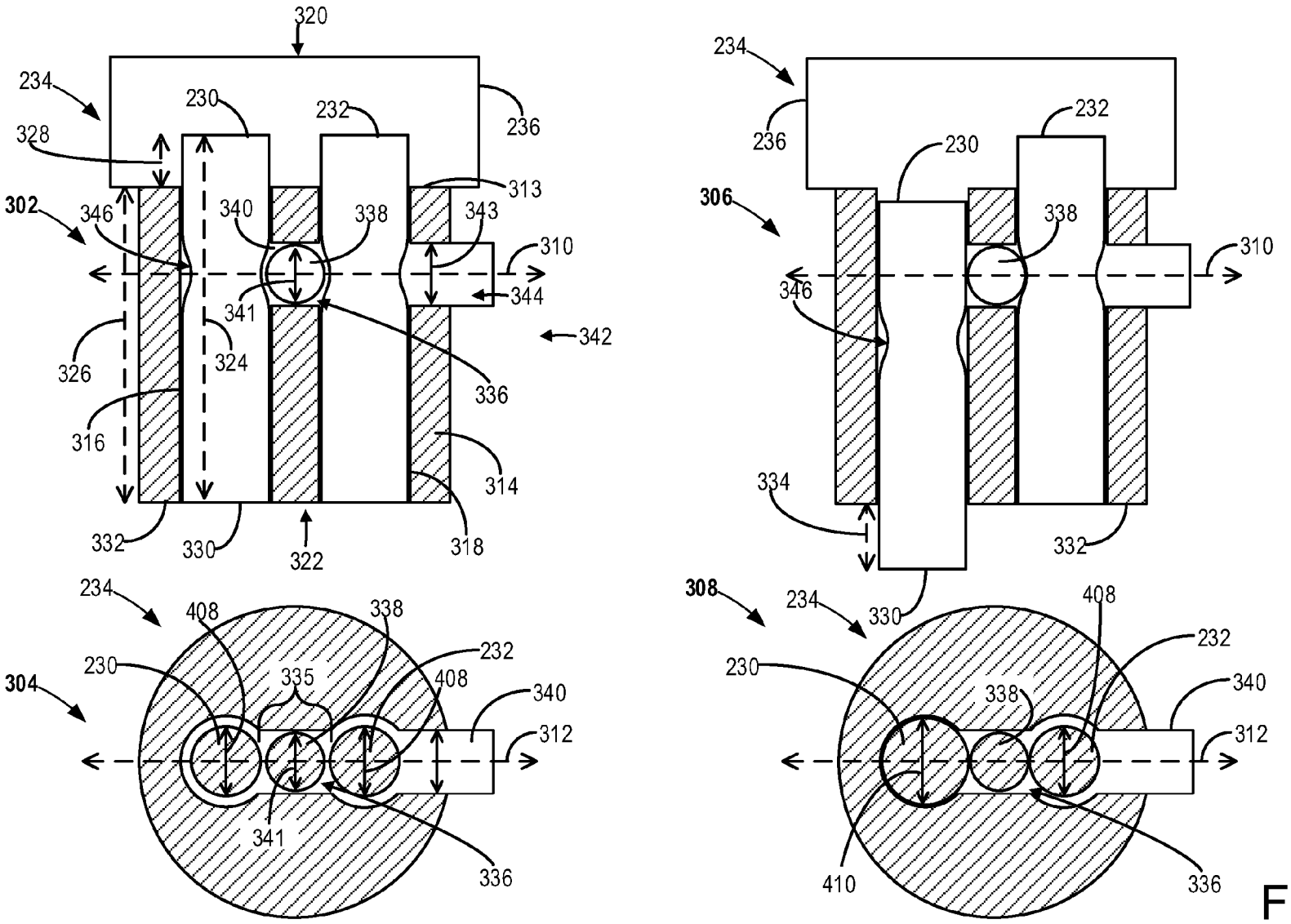
FIG. 3 shows an example cam lobe switching actuator in accordance with the disclosure.

FIG. 3 shows a first example cam lobe switching actuator 234 with a ball locking mechanism 336 from different viewpoints and during different example operational modes. For example, at 302, FIG. 3 shows cam lobe switching actuator 234 from a side view when both pins 230 and 232 are in a home position and at 304, FIG. 3 shows a cross section of actuator 234 along line 310 when both pins are in the home position. The view shown at 302 is a cross-sectional view of the actuator along the center line 312 shown at 304.

At 306, FIG. 3 shows cam lobe switching actuator 234 from a side view when pin 230 is deployed and pin 232 is maintained in the home position and at 308, FIG. 3 shows a cross section of actuator 234 along line 310 when pin 230 is deployed and pin 232 is maintained in the home position. The view shown at 306 is a cross-sectional view of the actuator along the center line 312 shown at 308.

It should be understood that cam lobe switching actuator 234 may include any number of pins. For example, cam lobe switching actuator 234 may include only two pins 230 and 232 for a two lift profile system. However, in other examples, cam lobe switching actuator 234 may include more than two pins, e.g., cam lobe switching actuator 234 may include three pins for a three lift profile system.

Cam lobe switching actuator 234 includes an activating mechanism 236, which may be hydraulically powered, or electrically actuated, or combinations thereof. In one example, activating mechanism 236 may be a single activating mechanism coupled to both pins 230 and 232 in actuator 234. In response to a signal received from a controller, e.g., controller 12, activating mechanism 236 may be configured to supply a force to both pins 230 and 232 to push the pins away from the activating mechanism 236 towards a grooved sleeve, e.g., sleeve 224 shown in FIG. 2. In response to a second signal received from the controller, activating mechanism 236 may be configured to discontinue applying the force to both pins.

For example, activating mechanism 236 may comprise an electromagnetic coil positioned above both pins 230 and 232. The coil may be configured to be selectively energized, e.g., via a current supplied to the coil, and selectively de-energized, e.g., via removing the current supplied to the coil. In this way, during an energized state of the coil, a force, e.g., an electromagnetic force, may be supplied to both pins 230 and 232 to push the pins towards the sleeve and during a de-energized state of the coil, the force supplied to both pins may be removed so that the pins are moveable within the bores 316 and 318 in an unbiased manner. Generally, some type of magnetic or mechanical mechanism will be employed to hold the pins in the home position when the coil is de-energized. Without this, there would be nothing to prevent a pin falling into a groove when de-energized. This mechanism will not move a fully extended pin back to the home (retracted) position, but will keep a retracted pin from extending.

Cam lobe switching actuator 234 includes a body 314 with a first bore 316 and a second bore 318 extending vertically from a top side 320 of body 314 to a bottom side 322 of body 314. For example, body 314 may be a substantially solid metal component with bores 316 and 318 extending therethrough to create orifices in the body so that first pin 230 is contained or housed within first bore 316 and second pin 232 is contained or housed within second bore 318. In some examples, the bores and pins may be significantly longer in length than their diameter. The pins may be moveable within their respective bores in a vertical direction from top side 320 of body 314 to bottom side 322 of body 314. As remarked above, during certain conditions, movement of the pins within the bores may be biased by a force applied to the pins from the activating mechanism 236.

A height of the pins, e.g., height 324 of first pin 230, may be larger than a height 326 of body 314. Further, the height of each pin in actuator 234 may be substantially the same. As remarked above, each pin may be slideable within the bore which houses it. For example at 302 in FIG. 3, pins 230 and 232 are shown in a home position within actuator 234. In the home position, the pins may extend a positive distance 328 above a top surface 313 of body 314 whereas the bottom surfaces of the pins, e.g., bottom surface 330 of pin 230, may be flush with bottom surface 332 of body 314 so that the pins do not extend beyond the bottom surface of body 314 in the home position.

However, in response to actuating the activating mechanism 236, one or both pins may be moved or deployed to an extended position. For example, as shown at 306 in FIG. 3, pin 230 has been moved away from its home position towards bottom side 322 of body 314 so that bottom surface 330 of pin 230 extends a positive, non-zero distance 334 beyond bottom surface 332 of body 314. During other conditions, the second pin may be deployed in a similar manner to extend beyond the bottom surface of the actuator body 314.

For example, in response to a lift profile change event, actuating mechanism 236 may be energized to apply a force to both pins 230 and 232 in order to bias the pins downward away from the top surface 313 of actuator body 314 toward a grooved outer sleeve, e.g., sleeve 224 shown in FIG. 2, so that pin 230 extends beyond the bottom surface 332 of body 314 to engage a groove, e.g., groove 226, in a sleeve, e.g., sleeve, 224, positioned below the actuator body 314. Upon engagement with the groove, pin 230 may initiate a cam lift profile change by pushing the sleeve into a different position along the cam shaft.

Cam lobe switching actuator 234 includes a ball locking mechanism 336 positioned between bores 316 and 318 in body 314. Ball locking mechanism 336 includes a ball or solid sphere 338 positioned within a hole or orifice 340 between bores 316 and 318. Orifice 340 may extend perpendicularly to the bores towards a side 342 of body 314 and may, in some examples, form an opening 344 in side 342 of body 314. For example, the opening 344 may permit ball 338 to be replaced when the pins are removed from the body 314 during maintenance. However, in other examples, orifice 340 may only extend between first bore 316 and second bore 318 and may not extend out the side 342 of body 314.

Ball 338 may be a solid metal ball moveable within orifice 340 between the bores 316 and 318. For example, a diameter 341 of ball 338 may be substantially the same as a diameter 343 of orifice 340 but may be slightly smaller than diameter 343 so that ball 338 is moveable in a horizontal direction along line 310 between the first and second bores in body 314.

Each pin includes an indentation region 346 at a location along the pin adjacent to orifice 344 when the pins are in the home position within body 314. As described in more detail below, an indentation region along a pin may be a curved indentation that extends around the outer circumference of the pin into the solid body of the pin so that ball 338 may engage the indentation in the pin during certain conditions.

Figure 4:
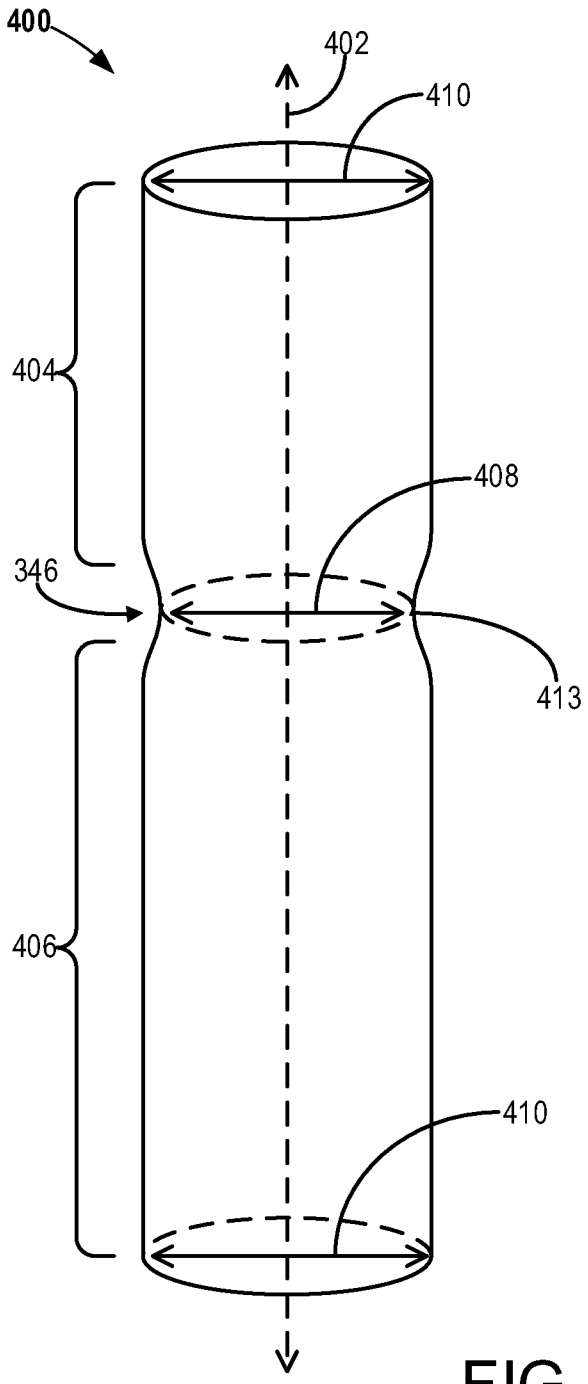
FIG. 4 shows an example actuating pin in accordance with the disclosure.

For example, FIG. 4 shows an example pin 400 with a central axis 402 extending through pin 400. For example, pin 400 may be pin 230 or pin 232 shown in FIG. 3 and axis 402 may extend in a direction from top 320 to bottom 322 of actuator 234. Pin 400 include a top region 404 and a bottom region 406 separated by indentation region 346. In some examples, a length of top region 404 may be less than a length of bottom region 406. However, in other examples, the length of top region 404 may be greater than or substantially equal to the length of bottom region 406.

At the indentation region a diameter 408 of the pin may be less than a diameter 410 of the top and bottom regions of the pin. At the indentation region 346, the diameter 410 of the pin may decrease to smaller diameter 408 to form a curved indentation or cut-out into the body of pin along the outer diameter of the pin. For example, a trough 413 may be formed along the outer perimeter of the pin at the indentation so that ball 338 may engage the indentation during certain conditions. As shown at 304 in FIG. 3, a distance 335 between the pins at the indentation regions of both pins may be greater than the diameter 341 of ball 338 so that ball 338 is moveable between the troughs of the indentations of the pins when both pins are in the home position. However, as shown at 308 in FIG. 3, when one of the pins is deployed, e.g., when pin 230 is deployed, while the other pin remains in the home position, e.g., while pin 232 remains in the home position, then ball 338 may engage the indentation in second pin 232 to lock the second pin in place while the other pin is deployed. Thus, the diameter 341 of ball 338 may be substantially the same length as the distance 337 between the first pin at a non-indentation region and the second pin at the indentation region so that, when the first pin 230 is deployed, the first pin pushes ball 338 into the indentation of the second pin 232 and maintains the ball within the indentation in the second pin in order to lock the second pin in the home position while the first pin is deployed or pushed downward toward sleeve 224.

Figure 5:
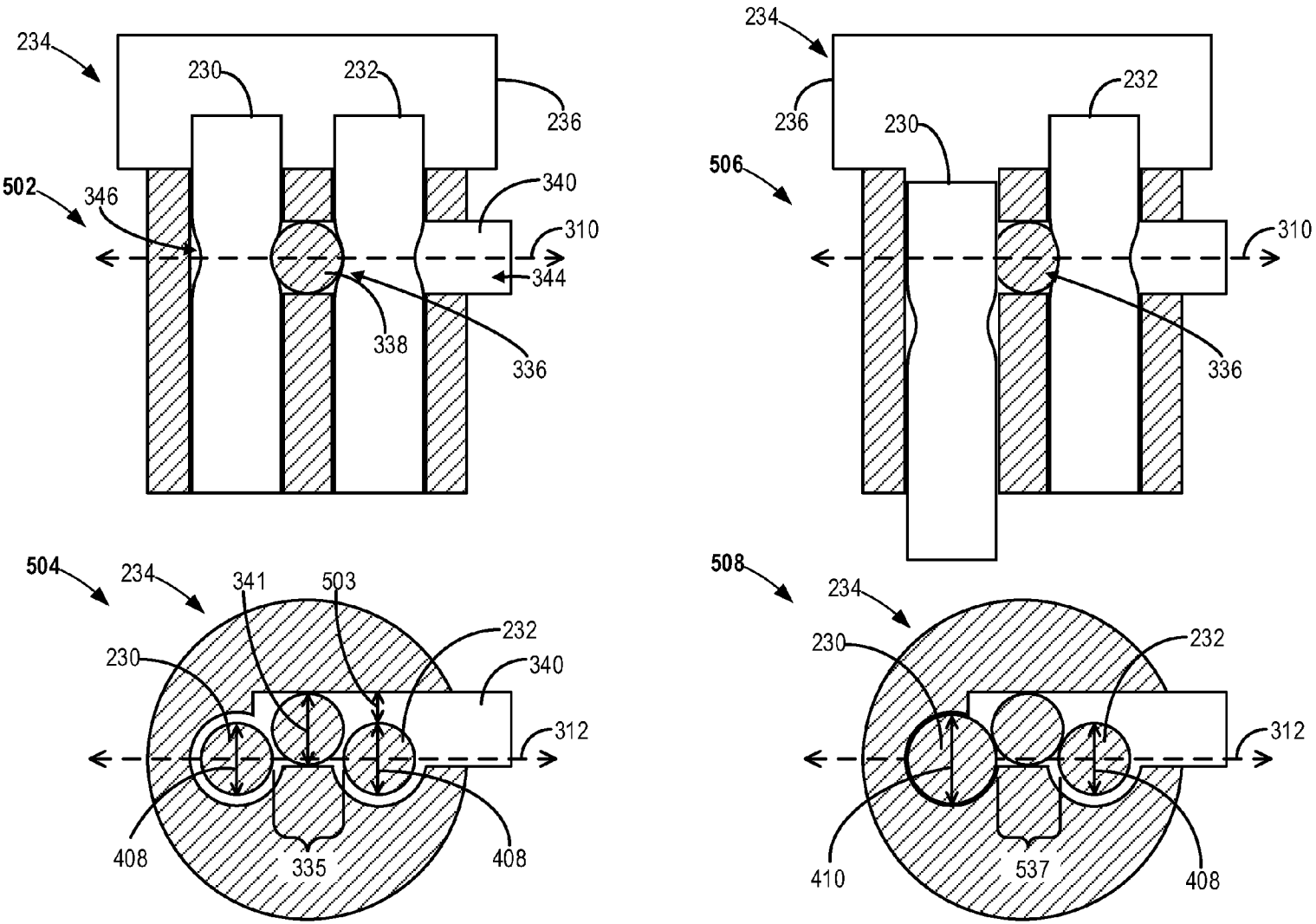
FIG. 5 shows another example cam lobe switching actuator in accordance with the disclosure.

FIG. 5 shows another example cam lobe switching actuator 234 with a ball locking mechanism 336 from different viewpoints and during different example operational modes. Like numbers shown in FIG. 5 correspond to like-numbered elements shown in FIG. 3 described above.

At 502, FIG. 5 shows cam lobe switching actuator 234 from a side view when both pins 230 and 232 are in a home position and at 504, FIG. 5 shows a cross section of actuator 234 along line 310 when both pins are in the home position. The view shown at 502 is a cross-sectional view of the actuator along the center line 312 shown at 504.

At 506, FIG. 5 shows cam lobe switching actuator 234 from a side view when pin 230 is deployed and pin 232 is maintained in the home position and at 508, FIG. 5 shows a cross section of actuator 234 along line 310 when pin 230 is deployed and pin 232 is maintained in the home position. The view shown at 506 is a cross-sectional view of the actuator along the center line 312 shown at 508.

In the example shown in FIG. 5, the ball locking mechanism is positioned offset from center line 312 of the actuator body 314 so that the orifice 340 extends behind pin 232 to form an opening 344 in the side of the actuator body. As shown at 504, ball 338 is offset a distance 503 from the center line 312 extending through the pins 230 and 232. In this example, the diameter 341 of ball 338 may be larger than the diameter of the ball shown in FIG. 3. For example, diameter 341 may be substantially the same length as the diameters 408 of the pins at the indentation region. In other examples, diameter 341 may be larger than the diameters 408 of the indented portions of the pins. For example, the diameter 341 of the ball may be substantially the same as the sum of the offset distance 503 plus the radius, i.e., ½ of the diameter 408, of the pins at the indentation region.

As shown at 504 in FIG. 5, a distance 335 between the pins at the indentation regions of both pins may be substantially the same or less than the diameter 341 of ball 338 so that ball 338 is moveable between the troughs of the indentations of the pins when both pins are in the home position. However, as shown at 508 in FIG. 3, when one of the pins is deployed, e.g., when pin 230 is deployed, while the other pin remains in the home position, e.g., while pin 232 remains in the home position, then ball 338 may engage the indentation in second pin 232 to lock the second pin in place while the other pin is deployed. Thus, the diameter 341 of ball 338 may be substantially the same length as the distance 537 between the first pin at a non-indentation region and the second pin at the indentation region at a position offset from center line 312 so that, when the first pin 230 is deployed, the first pin pushes ball 338 into the indentation of the second pin 232 and maintains the ball within the indentation in the second pin in order to lock the second pin in the home position while the first pin is deployed or pushed downward toward sleeve 224.

Figure 6:
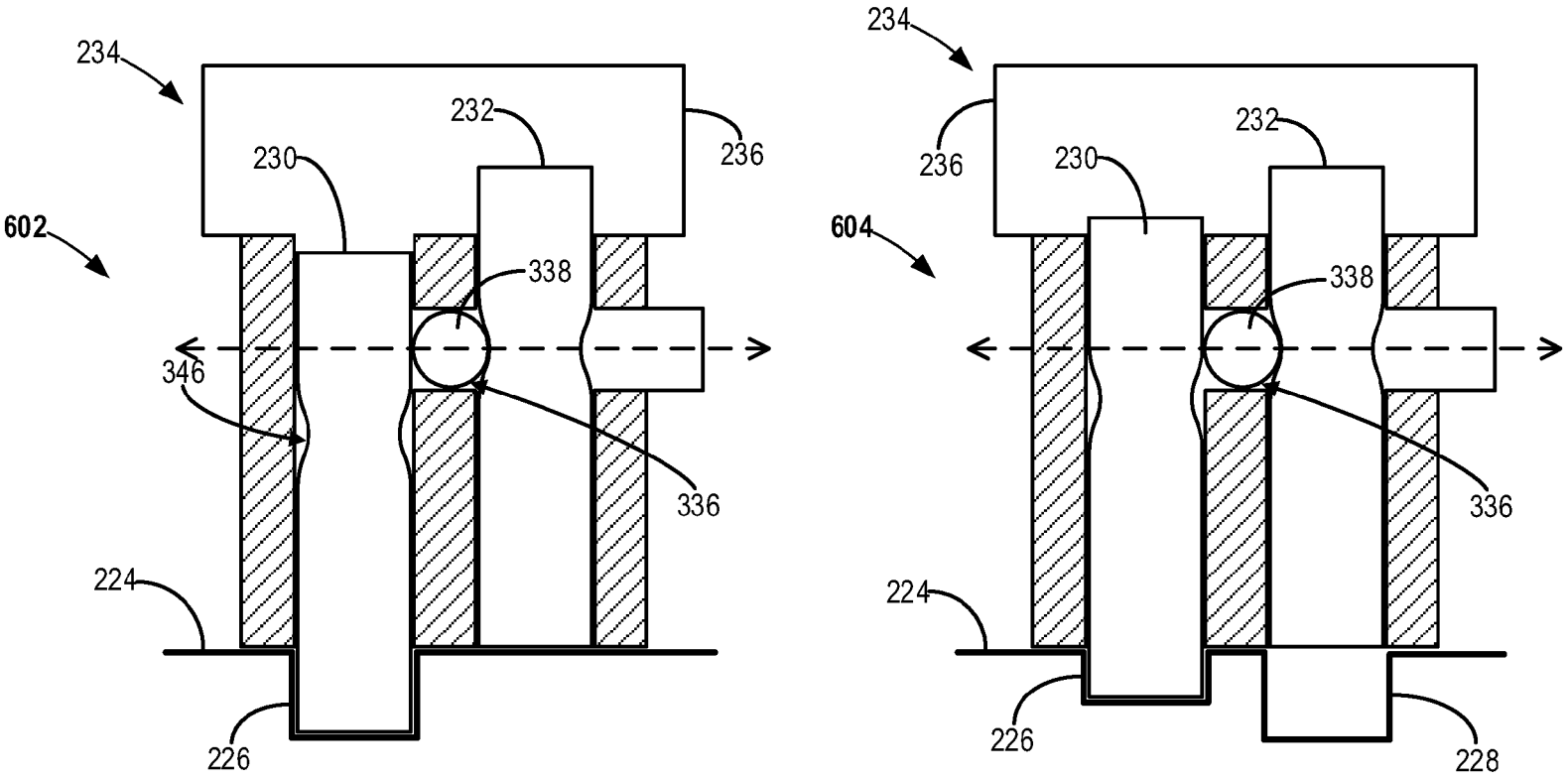
FIG. 6 shows an example cam lobe switching actuator engaging with a sleeve.

FIG. 6 illustrates an example implementation of cam lobe switching actuator 234 during a lift profile switching event. For example, following a lift profile change request, e.g., in response to a change in engine load, speed, or other operating parameter, actuating mechanism 236 may be energized to supply a force to both pins 230 and 232 to push the pins toward outer sleeve 224. As shown at 602, pin 232 is held in the home position by an absence of a groove in the surface of sleeve 224 whereas pin 230 is deployed into a groove 226 in the surface of sleeve 224 below pin 230 so that pin 230 is moved downward into groove 226 in sleeve 224. The downward movement of pin 230 moves the indentation region 346 downward towards sleeve 224 thus causing ball 338 to be pushed into the indentation region of pin 232 to lock pin 232 in place.

As shown at 604, when the first pin 230 is deployed, ball 338 is maintained in a locked position in the indentation of the second pin 232. As the sleeve 224 rotates, a second groove 228 may be present beneath pin 232 while the first pin 230 is deployed in the first groove 226. However, since the second pin 232 is locked into place by the ball 338, the second pin will not deploy into the second groove 228 while the first pin is deployed even while a force is applied to the second pin via the actuating mechanism 236. In some examples, after the first pin 230 has engaged a groove in sleeve 224, the actuating mechanism may be de-energized to remove the force applied to both pins.

As the sleeve 224 continues to rotate, a depth of the first groove may decrease pushing first pin 230 back towards its home position. When the first pin reaches its home position, the indentation in first pin 230 again lines up with ball 338 releasing the ball from a locked position against second pin 232 so that pin 232 may be deployed if desired.

Figure 7:
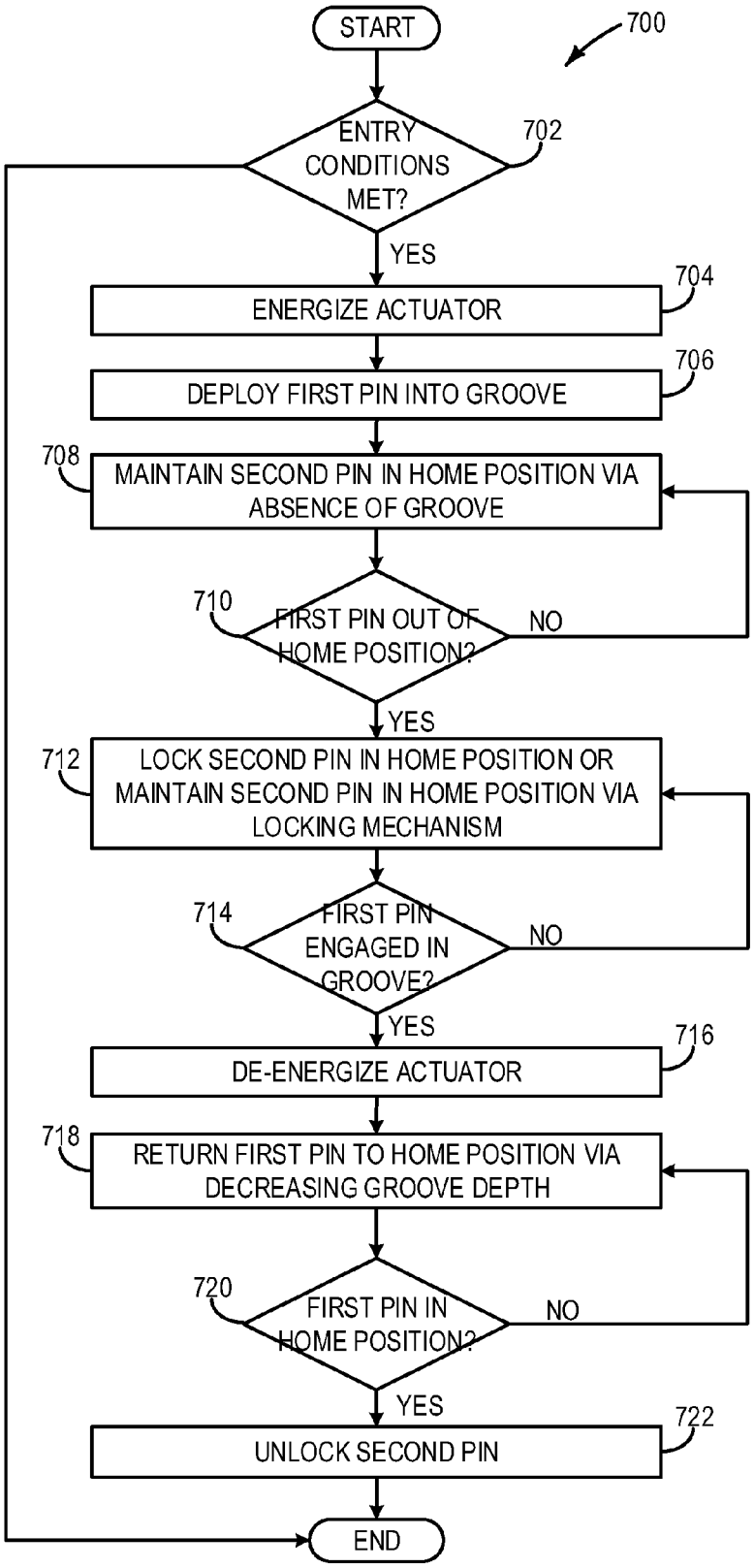
FIG. 7 shows an example method for a multiple-lift profile cam lobe switching mechanism actuator in accordance with the disclosure.

FIG. 7 shows an example method 700 for a multiple-lift profile cam lobe switching mechanism actuator, such as the actuators 234 shown in FIGS. 2-6 described above. Method 700 may be used for changing a lift profile using a first pin while preventing a second pin from deploying after the first (intended) pin has deployed by using a mechanical locking mechanism, such as ball locking mechanism 336, within the actuator.

At 702, method 700 includes determining if entry conditions are met. Entry conditions may include entry conditions for changing a lift profile of a valve in an engine, such as the engine shown in FIG. 1. For example, entry conditions may include a change in engine speed, engine load, or other engine operating parameter. If entry conditions are met at 702, method 700 proceeds to 704.

At 704, method 700 includes energizing the actuator. For example, actuating mechanism 236 may be energized to supply a force to both pins 230 and 232 in actuator 234 to push the pins toward sleeve 224. As described above, actuating mechanism 236 may be a coil coupled to or adjacent to the pins in the actuator. In this example, energizing the actuator may include supplying a current to the coil so that an electromagnetic force is directed to the pins to bias them toward the sleeve.

At 706, method 700 includes deploying a first pin into a groove. For example, deploying a first pin into a groove of a camshaft outer sleeve may include energizing a coil coupled to the first and second pins. For example, first pin 230 may be directed into a first groove 226 in outer sleeve 224 via the force from actuating mechanism 234 applied to all the pins of the actuator.

At 708, method 700 includes maintaining a second pin in a home position via an absence of a groove. For example, as described above with reference to FIG. 6, though the actuating mechanism 234 applies a force to both pins 230 and 232, initially there may be no groove underneath second pin 232. This absence of a groove in sleeve 224 beneath second pin 232 prevents second pin 232 from deploying while first pin 230 initially deploys into the groove beneath it.

At 710, method 700 includes determining if the first pin is out of the home position. If the first pin is not out of the home position at 710, then method 700 continues to maintain the second pin in the home position via the absence of the groove. However, if the first pin has moved out of the home position at 710, then method 700 proceeds to 712. At 712, method 700 includes locking the second pin in the home position or maintaining the second pin in the home position via a locking mechanism.

For example, as described above with regard to FIG. 6, when the first pin deploys out of the home position into the groove in the sleeve beneath it, the first pin pushes ball 338 into the indentation in the second pin to lock the second pin in place. The second pin is thus maintained in place with the ball locking mechanism even after the second pin is exposed to a vacated groove in the camshaft outer sleeve. In this way, the second pin may be maintained in place with the ball locking mechanism while the energized state of the coil is maintained.

At 714, method 700 includes determining if the first pin is engaged in the groove. For example, at 714, method 700 may include determining if the first pin 230 has extended sufficiently, e.g., a threshold distance, into the first groove in order to initiate a change in position of the sleeve along the cam shaft in order to change the lift profile as the sleeve rotates about the cam shaft. If the first pin is not engaged in the groove, method 700 returns to 712 to maintain the second pin in the home position via the locking mechanism while the first pin is deployed.

However, if the first pin is engage in the groove at 714, then method 700 proceeds to 716. At 716, method 700 includes de-energizing the actuator. For example, once the first pin engages the first groove, the coil may be de-energized to remove the force applied to both pins. As described above, de-energizing the coil may include discontinuing a current supplied to the coil.

At 718, method 700 includes returning the first pin to the home position via a decreasing groove depth. As remarked above, the first groove into which the first pin is deployed may having a decreasing depth in sleeve 224 as the sleeve rotates about the cam shaft. This decreasing depth of the groove will push the first pin back towards the home position. Thus, at 720, method 700 includes determining if the first pin is in the home position. If the first pin is not in the home position at 720, method 700 continues to return the first pin to the home position via the decreasing groove depth at 718.

However, if the first pin is at the home position at 720, then method 700 proceeds to 722. At 722, method 700 includes unlocking the second pin. In particular, when the first pin returns to the home position, the indentation in the first pin is again aligned with ball 338 thus releasing the ball from the locked position against the second pin so that the second pin may be deployed during a subsequent lift-profile change event. For example, method 700 may also be used to hold the first pin in a locked position after the second pin is deployed and aligned with a groove before the first pin.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a multiple-lift profile cam lobe switching mechanism actuator, comprising:

providing direct fuel injection;

deploying a first pin into a groove of an overhead-camshaft outer sleeve while a second pin remains in place due to an absence of a groove in which to deploy; and maintaining the second pin in place with a ball locking mechanism even after the second pin is exposed to a vacated groove in the overhead-camshaft outer sleeve.

2. The method of claim 1, wherein deploying a first pin into a groove of a camshaft outer sleeve includes applying a force to the first and second pins and wherein maintaining the second pin in place with the ball locking mechanism is performed while maintaining the force applied to the first and second pins.

3. The method of claim 2, wherein applying a force to the first and second pins includes energizing a coil coupled to the first and second pins and wherein maintaining the second pin in place with the ball locking mechanism is performed while maintaining an energized state of the coil, and the method further comprises de-energizing the coil after the first pin engages the groove.

4. The method of claim 3, further comprising returning the first pin to a home position during a decreasing depth in the groove.

5. The method of claim 4, further comprising, in response to an engine operating condition, energizing the coil to deploy the second pin into a groove in the overhead camshaft outer sleeve while the first pin remains in place due to the absence of a groove in which to deploy, and maintaining the energized state of the coil even after the first pin is exposed to a vacated groove while the first pin remains in place due to the ball locking mechanism.

6. The method of claim 5, wherein the engine operating condition is a change in engine speed and/or load, and wherein the ball locking mechanism includes a ball positioned adjacent to and contiguous with reduced diameter sections of each of the first and second pins.

7. The method of claim 1, wherein the ball locking mechanism engages an indentation in a non-deployed pin in response to a deployment of another pin.

8. The method of claim 7, wherein the ball locking mechanism disengages the indentation in the non-deployed pin in response to the other pin returning to a home position.

9. A method for a multiple-lift profile cam lobe switching mechanism actuator in an engine, comprising:

biasing a first pin and a second pin toward an overhead camshaft outer sleeve;

deploying the first pin into a groove of the overhead camshaft outer sleeve while the second pin remains in place due to an absence of a groove in which to deploy; and maintaining the second pin in place with a ball locking mechanism even after the second pin is exposed to a vacated groove in the overhead camshaft outer sleeve.

10. The method of claim 9, wherein biasing the first and second pins toward the camshaft outer sleeve includes supplying a current to a coil adjacent to the first and second pins.

11. The method of claim 10, further comprising, in response to an engagement of the first pin in the groove, discontinuing the supply of current to the coil.

12. The method of claim 9, wherein deploying the first pin into a groove of the overhead camshaft outer sleeve includes energizing a coil coupled to the first and second pins and wherein maintaining the second pin in place with the ball locking mechanism is performed while maintaining an energized state of the coil.

13. The method of claim 9, further comprising, in response to a decreasing depth in the groove, returning the first pin to a home position.

14. The method of claim 9, wherein the ball locking mechanism engages an indentation in a non-deployed pin in response to a deployment of another pin.

15. The method of claim 14, wherein the ball locking mechanism further disengages the indentation in the non-deployed pin in response to the other pin returning to a home position.

* * * * *